US010012037B2

(12) United States Patent
Eriksen

(10) Patent No.: US 10,012,037 B2
(45) Date of Patent: Jul. 3, 2018

(54) HEAVE COMPENSATION METHOD

(71) Applicant: Electrical Subsea & Drilling AS, Straume (NO)

(72) Inventor: Egil Eriksen, Vassenden (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 0 days.

(21) Appl. No.: 15/523,911

(22) PCT Filed: Dec. 1, 2015

(86) PCT No.: PCT/NO2015/050233

§ 371 (c)(1),
(2) Date: May 2, 2017

(87) PCT Pub. No.: WO2016/089217

PCT Pub. Date: Jun. 9, 2016

(65) Prior Publication Data

US 2017/0321499 A1 Nov. 9, 2017

(30) Foreign Application Priority Data

Dec. 2, 2014 (NO) ..... 20141447

(51) Int. Cl.
*E21B 17/01* (2006.01)
*E21B 19/00* (2006.01)
*E21B 19/09* (2006.01)

(52) U.S. Cl.
CPC ..... *E21B 19/006* (2013.01)

(58) Field of Classification Search
CPC ..... E21B 17/07; E21B 19/006; E21B 19/09
See application file for complete search history.

(56) References Cited

U.S. PATENT DOCUMENTS 4,962,817 A * 10/1990 Jones ..... E21B 19/09 166/355
6,688,814 B2 * 2/2004 Wetch ..... E21B 19/004 166/355

(Continued)

FOREIGN PATENT DOCUMENTS

| | | |
|---|---|---|
| WO | 2008068445 A1 | 6/2008 |
| WO | 2013119127 A1 | 8/2013 |
| WO | 2013134254 A1 | 9/2013 |

OTHER PUBLICATIONS

Norwegian Search Report dated May 28, 2015 for Application No. 20141447.

(Continued)

*Primary Examiner* — Matthew R Buck
(74) *Attorney, Agent, or Firm* — Patterson & Sheridan, LLP

(57) ABSTRACT

A method of heave compensation between a floating installation, which has a drilling floor, and at least a riser or a pipe extending down towards, possibly through, a blowout preventer, the method including the steps of—installing an electromechanical actuator with attachment points, in the form of an end cap and an anchoring point, between the floating installation and a suspension device for the riser or the pipe; connecting the electromechanical actuator to a power supply and a control system; and heave-compensating for the relative displacement between the floating installation and the riser or the pipe by letting the control system adjust the length and power output of the electromechanical actuator.

4 Claims, 4 Drawing Sheets

(56) References Cited

U.S. PATENT DOCUMENTS

| | | | | |
|---|---|---|---|---|
| 7,851,962 | B1 * | 12/2010 | Williams | H02K 16/04 310/113 |
| 2009/0053030 | A1 | 2/2009 | Humble et al. | |
| 2009/0133881 | A1 * | 5/2009 | Roodenburg | B63B 17/00 166/355 |

OTHER PUBLICATIONS

International Search Report and Written Opinion dated Feb. 24, 2016 for Application No. PCT/NO2015/050233.

* cited by examiner

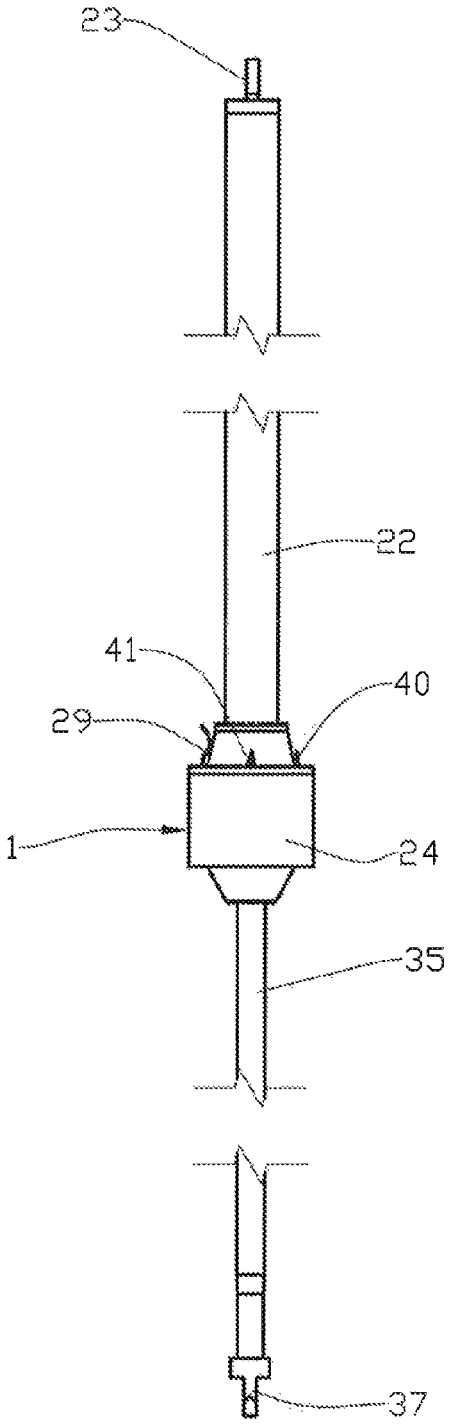
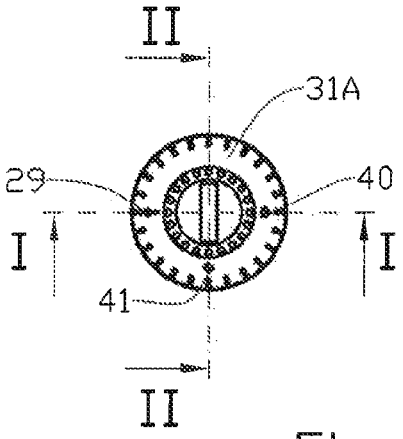
Fig. 3a
Fig. 3

HEAVE COMPENSATION METHOD

This invention relates to a method of heave compensation between a floating installation which has a drilling floor and at least a riser or a pipe extending down towards, possibly through, a blowout preventer (BOP). Ocean waves give an up-and-down motion of a floating installation, known as heave. To compensate for this, different solutions are used for heave compensation between the floating installation and components, which are secured to the sea floor or should have the smallest possible unintended vertical displacement. Often, there are actuators associated with an active or passive heave-compensation system. Conventionally, actuators of this kind have been hydraulic cylinders. Passive compensation is then done via a hydraulic/pneumatic system.

Weaknesses of the heave-compensation systems may give interruptions in operations in bad weather and problems during operations. Inadequate control of power output when compensating a riser-anchoring system may give fatigue problems in the riser and the wellhead. During drilling, variation in weight on the drill bit may result in variation in the torque, which may give increased wear and damage to the drill bit and reduced rate of penetration when drilling.

Improvements to heave-compensation systems may thus contribute to an increased operational weather window for drilling and well-intervention vessels and improved control of power output and movements.

Heave compensation is done actively, semi-actively or passively.

In active heave compensation, hydraulic energy is actively supplied to the system as a function of heave measurements. Active or semi-active heave compensation with cylinders is used to isolate movements of a hanging load from the movements of the rig, among other things when lowering equipment through the splash zone in the sea surface, landing equipment at the seabed or during drilling operations in which it is desirable to keep a constant weight on the drill bit.

For the heave compensation of a hanging load, cylinders are used between the crown block and the derrick, or between the travelling block and the hook. Passive hydraulic/pneumatic heave-compensation systems have in common that the compression side of the cylinder piston of a hydraulic cylinder is hydraulically connected to a high-pressure gas volume, which works as a pneumatic spring. The other side of the cylinder piston is connected to a low-pressure gas volume. The motion of the load owing to heave is dampened by the compression or expansion of a gas.

A passive system will not be able to compensate heave movements sufficiently, mainly because of friction, hydraulic pressure loss and pressure variation in the pneumatic system. Active compensation will work better, but requires a great amount of hydraulic energy. In a semi-active system, a passive system takes care of the greater part of the movements and the hydraulic-energy requirement is reduced, whereas an active, hydraulic supplementary system takes care of the remaining movements. The passive system is also a back-up system by possible faults in the active heave-compensation system, and the system absorbs some of the heave motion.

In subsea drilling, well completion and workover, a heave-compensated riser system is used with the lower end connected to a blowout preventer (BOP) on the seabed equipment. The tensioning system is to maintain a tensioning that keeps the riser stable, while, at the same time, compensating passively for the vertical motion of the vessel.

When there are no waves, the piston is in a middle position. As the rig is lifted up, hydraulic fluid is driven out of the cylinder and compresses the high-pressure gas volume, whereas the gas expands and drives the hydraulic fluid back into the cylinder when the rig is going downwards. The tension on the hydraulic cylinder is to keep the riser approximately straight, ensure safe disconnection of the BOP and not transmit tension to the wellhead, the latter being avoided by means of the weight of the BOP. Guidelines for the minimum top tension on the riser is given by the American Petroleum Institute (API 16Q).

The tensioning system for the riser is attached to a tension ring. In drilling operations and well completion, the tension ring is attached to the outer part of a telescopic joint which, in its lower end, is connected to the riser (marine riser) itself. At its upper end, the inner part of the telescopic joint is attached to an upper flex-joint. The telescopic joint absorbs vertical movements between the rig and the point of suspension of the riser. Alternatively, a slimmer riser (open-water workover riser) is used for the workover of subsea wells, connected to the top of a subsea Christmas tree with a workover system including well-barrier valves and a disconnecting device. In this case, the tension ring is attached to a riser tension joint.

There are several technical solutions for riser-tensioning systems. Conventionally, they have been based on wirelines, which are connected via snatch blocks to the tension ring of the riser and are attached to compensation cylinders. A more recent solution, which is used to a great extent on deep-water rigs, is to connect hydraulic cylinders directly to the tension ring. This contributes to better access and space for other equipment aboard the vessel, reduced cost, reduced weight, higher capacity, better response, controlled riser recoil on disconnection, reduced need for maintenance and no wire wear with a risk of wire rupture. Typically, six cylinders are connected to the tension ring and the system is dimensioned in such a way that it will be operative if up to two cylinders become inoperative.

Fatigue in subsea wellheads because of the strain from BOPs has turned out to be a challenge to well integrity. The wellhead and the upper part of the casing of the well are affected by forces from the rig via the riser. Primarily, it is lateral forces, which cause problems. The hysteresis of the tensioning system may contribute to strain on the wellhead. Global riser models used in the industry for riser analysis have generally not included the dynamics of the tensioning system, only included the top tension through a simplified approach. The tension varies because of flow resistance through the hydraulic pipe system, laminar or turbulent flow of the medium depending on velocity, the viscosity of the medium, temperature, gas dynamics, piston friction (which varies with the speed of the piston) and inertia forces in the system.

The riser is disconnected from the BOP when the weather is bad or in unforeseen situations. Riser recoil occurs when elastic energy in the mounted riser is released. Wirelines in a wire-based tensioning system automatically slacken on riser recoil.

The forces in disconnecting increase with the water depth, and this makes greater demands on optimum recoil control. For deep-water rigs, it is usual to have direct-coupled cylinders, which enable controlled braking of the riser. The hydraulic system of the tensioning system is provided with a recoil valve. During normal operation, the recoil valve is fully open, but during disconnection, it is operated via a control system, so that it throttles the fluid flow to the actuator. The braking prevents the riser from recoiling into the drilling floor and must be controlled to prevent deformation of the pipe lengths by compression and buckling of the upper part of the riser because of inertia forces in the lower part. The movement is to be stopped before the inner telescopic joint bottoms out in the outer one. At the same time, the lower end of the riser is to be pulled up high enough to avoid impact between the lower marine-riser package (LMRP) and the BOP after disconnection.

A limitation with today's solutions is the fact that, because of their weight, the hydraulic actuators should be stored upright to avoid pressure on the stuffing box and piston seals and eliminate possible leakage problems during operation because of seal deformation.

WO 2013/119127 A1 discloses an electromechanical actuator for use under water in petroleum activity. The invention is intended for the operation of a coupling device or an annular barrier element, in both cases via an annular piston, inside an actuator housing.

U.S. Pat. No. 8,157,013 B1 discloses a direct-coupled hydraulic/pneumatic tensioning system for a riser with a locally installed recoil valve and hydraulic volume.

U.S. Pat. No. 5,209,302 A discloses a semi-active heave-compensation system.

WO 2008/068445 A1 discloses a control system for active heave compensation.

The invention has for its object to remedy or reduce at least one of the drawbacks of the prior art, or at least provide a useful alternative to the prior art.

The object is achieved through the features, which are given in the description below and in the claims that follow.

Because of the drawbacks mentioned and others connected with hydraulic/pneumatic systems for heave compensation, electromechanical actuators have been developed for actively controlled riser anchoring and for the active heave compensation of a hanging load, respectively. Several parallel actuators are controlled from an electronic control system with adapted software for optimum power output, heave compensation and readjustment of the operation when required. The actuators are mounted in a manner corresponding to that of present-day hydraulic cylinders, adapted to the equipment of the vessel and the relevant application. The actuators are supplied with electrical power, cooling medium, lubrication medium and signal communication via flexible hoses and cable connections to the assigned on board equipment.

When the rig is lifted up, the motors are forced to spin in a backward direction, while they are to maintain a controlled power output through regenerative braking. In this situation, the motors work as generators and charge a battery pack associated with the electrical power-supply system.

Below, an electromechanical actuator, preferably for active heave compensation, will be described. The electromechanical actuator has at least one electric driving motor, including a stator and a rotor, in a motor casing. Via transmission elements, the electric driving motor is arranged to displace an actuation element with an outer end and an inner end supported internally in an actuator housing. The at least one driving motor is constructed and dimensioned to give a high torque, combined with a high rotational speed. During normal operation, the power requirement is lower than what the equipment is dimensioned for, and redundant motor power is disengaged. The driving motor(s) may include at least two separate sets of coils to give redundancy.

The electrical power-supply system is most advantageously arranged for regenerative braking during the upward motion of the rig and for storing the electrical energy that is generated from the kinetic energy of the rig.

The actuator housing is provided with a first anchoring point at an upper end and a motor casing with a rotatable actuator nut with electric motor operation at a lower end. The outer end of an actuation element that projects from the motor casing is provided with a second anchoring point.

The direction of motion of the actuation element is parallel to the rotary axis of the motor. The actuator is characterized by the rotor of the at least one driving motor surrounds and is connected via transmission elements to an actuator nut which is in threaded engagement with the actuation element via several threaded rollers. The structure enables a compact form of construction, in which relatively large actuation forces can be achieved. The solution, known from SKF's catalogues, for example, may be adapted to the actuator and constitutes a machine element in which relatively large forces can be transmitted with relatively little friction between the machine elements.

The motor casing may be provided with a first cooling jacket, which encircles the stator. A second cooling element may be placed internally in the cylindrical actuation element.

The motor casing will typically be certified for use in a hazardous area. For example, the Exp principle may be used. The enclosure is purged before start and pressurized with protective gas during operation, for example clean air or inert gas; alternatively, liquid is used. The inside of the enclosure is defined as a safe zone.

The motor(s) is/are preferably provided with at least two independent position indicators, which, via connection and signal processing in a control system, give information about the relative position of the actuation element in the actuator. The actuation force exerted on the actuation element by the motor(s) is controlled by adjusting the supply of power. The power output is measured via applied motor output and possibly also by measurement from a load bolt at the anchoring point of the actuator housing, with signal communication via a cable connection to the control system. A control system may thus continuously adjust the power and control the relative position of the actuation element in the actuator. Hysteresis and other limitations, which are known from hydraulic/pneumatic systems are avoided.

The actuator is provided with connectors for cables and hoses connecting the equipment to a power supply, air, cooling medium, lubrication medium and control system.

It is possible to compensate for a loss of one, possibly more, actuator(s) by dimensioning the actuators with backup capacity, so that the output on the active actuators may be increased to compensate for the missing tensioning from the actuators rendered inactive.

For long-time suspension of the riser, the actuator may be provided with an electronically activated brake.

According to the invention, a method of heave compensation between a floating installation, which has a drilling floor, and at least a riser or a pipe which extends down towards, possibly through, a BOP is provided, the method being characterized by including the steps of

- installing an electromechanical actuator with points of attachments in the form of an end cap, respectively an anchoring point, between the floating installation and the riser or pipe;
- connecting the electromechanical actuator to a power supply and a control system; and
- heave-compensating for the relative displacement between the floating installation and the riser or the pipe by letting the control system adjust the length and power output of the electromechanical actuator.

The method may further include the steps of controlling any recoil on the disconnection of the riser;

hoisting the riser to the upper position; and releasing the riser in the upper position by the electronically controlled engagement of a brake.

The method may further include the step of regenerating energy applied to the heave compensator in the form of mechanical load that is being displaced.

The method may further include the step of arranging an electric motor with both its stator and rotor encircling the actuation element of the electromechanical actuator.

The method may further include the step of connecting the rotor of the electric driving motor, via a planetary gear, to an actuator nut, which is in threaded engagement with the actuation element via several threaded rollers.

When the method is being implemented, the following is typically done:

the actuator nut is in threaded engagement with the actuation element;

the motor casing and the actuation element are supplied with a lubrication medium;

the motor casing and the actuation element are supplied with a cooling medium;

the motor casing is pressurized with air or inert gas;

electromechanical actuators are connected in parallel for active heave compensation of a hanging load;

electromechanical actuators are connected in parallel for active heave compensation and adjustment of the top tensioning of a riser;

in order to, by regenerative motor braking, convert kinetic energy from the upward movement of the vessel into electrical energy;

store and withdraw generated electrical energy in/from batteries associated with the electrical power-supply system;

by measuring the power input and signal communication from the actuators, via a cable connection to a control system, and exchanging data with other control systems and instruments, for example a riser management system (RMS)

control the actuation power exerted on the actuation element by the motors by means of the power input;

calculate the power output from the power input of the motor, measure the load applied to the anchoring point of the actuator housing, control the power and the relative positions of the actuation elements in the actuators for the heave compensation of a hanging load;

control the power and the relative positions of the actuation elements of the actuators for the compensation and optimum adjustment of the top tensioning of a riser;

controlledly brake riser recoil on disconnection;

hoist the riser to the upper position when disconnecting the riser;

lock the riser in the upper position by the electronically controlled engagement of a brake;

adjust up the power output when there is a loss of actuators, so that the overall output is maintained; and store data from the operation as required.

In what follows, examples of preferred embodiments are described, which are visualized in the accompanying drawings, in which:

FIG. 1 schematically illustrates an example of the use of the actuators for the compensation of a hanging load and tensioning of the anchoring system of a riser;

FIG. 3 shows a side view of an electromechanical actuator;

FIG. 3*a* shows a ground plan of the electromechanical actuator; and

Figure 4:
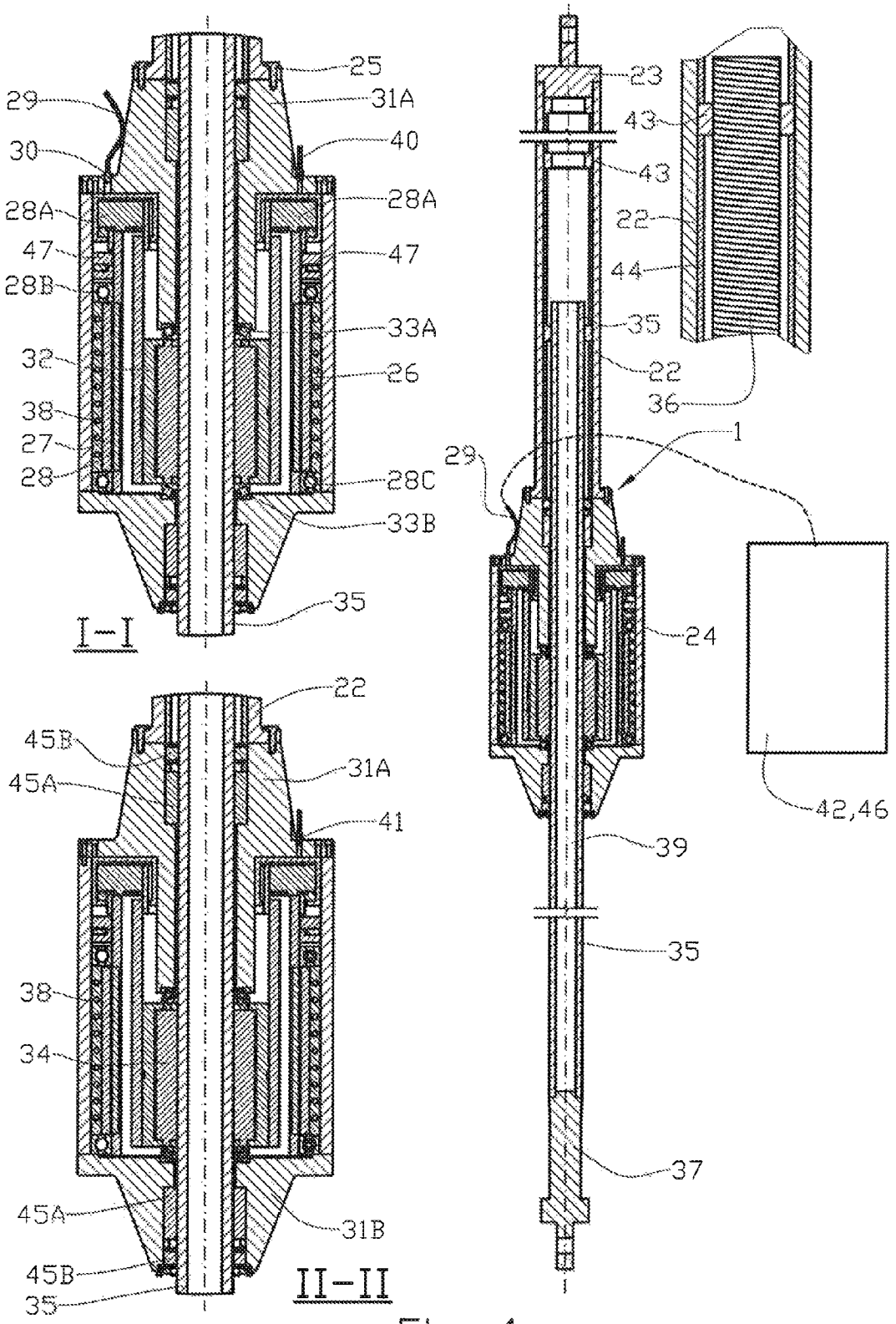

FIG. 4 shows the axial sections I-I and II-II according to FIG. 3*a* of the electromechanical actuator with details of the motor casing and the actuation element.

Figure 1:
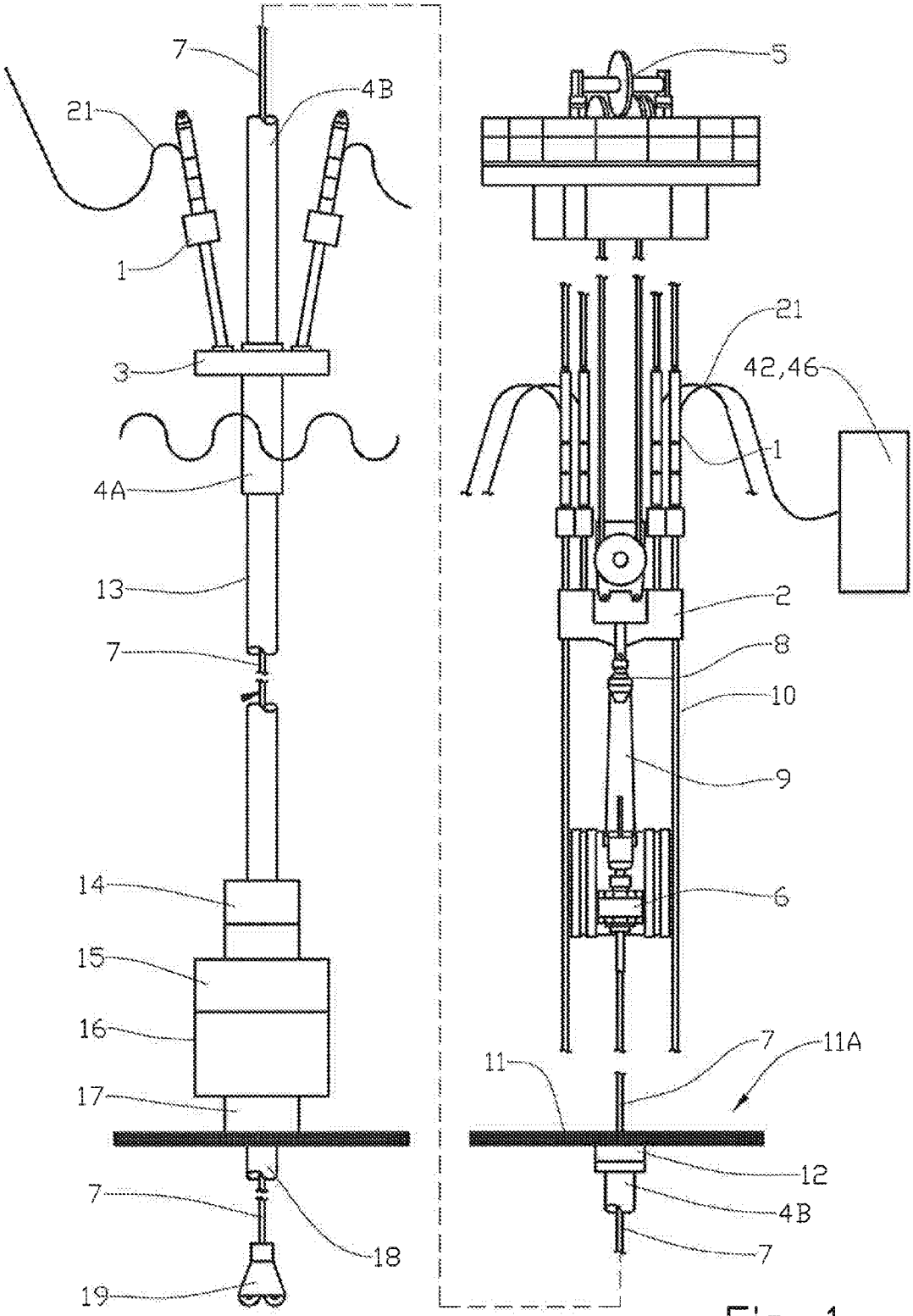

In the drawings, the reference numeral 1 indicates an electromechanical actuator for active heave compensation. In FIG. 1, the electromechanical actuator 1 is shown as being connected to a travelling block 2 and a suspension device 3 for the outer part 4A of a telescopic joint. The suspension device 3 is also called a riser tension ring in what follows.

The travelling block 2 is hoisted up and down by means of a hoisting winch 5. From the travelling block 2, a rotary device 6 for a pipe 7, shown here as a drill pipe, is hanging on a hook/swivel 8 and suspension rods 9. The travelling block 2 and the rotary device 6 are moved up and down along a vertical guiding device 10. The drill pipe 7 passes vertically through the rotary/diverter/upper flex-joint 12 of a drilling floor 11, the inner part 4B of the telescopic joint, the outer part 4A, a riser 13, a lower flex-joint 14, a lower marine-riser package 15, a BOP 16, a wellhead 17 and a casing 18 and, at the bottom, the drill pipe 7 ends in the drill bit 19. The drilling floor 11 is typically part of a floating installation 11A.

Figure 2:
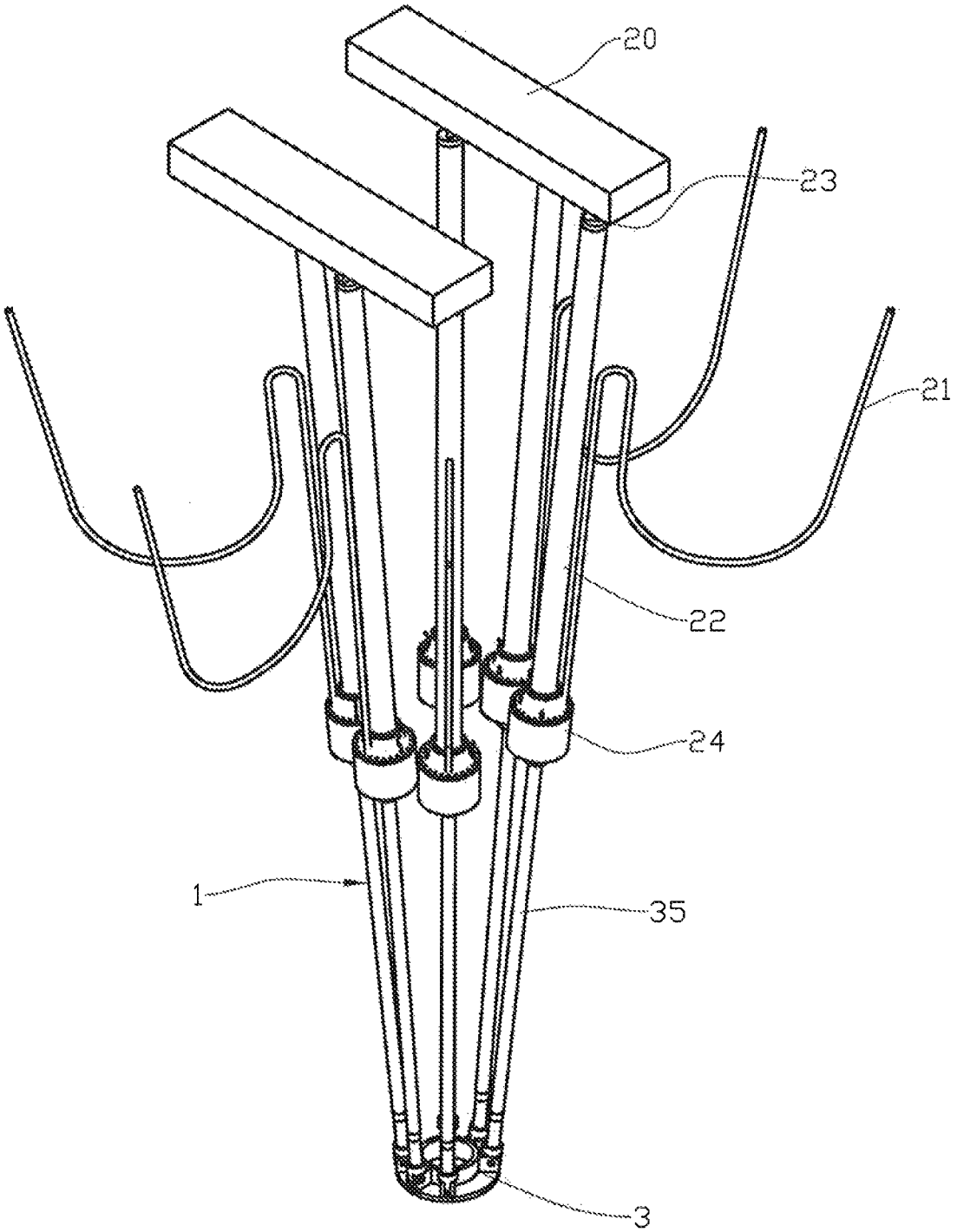
FIG. 2 shows a tensioning system for a riser with an upper attachment of several actuators which, at their lower ends, are attached to the tension ring of the riser.

FIG. 2 shows an active riser-tensioning system with an upper suspension 20 for the attachment of a number of actuators 1, the actuators 1 being attached at their lower ends to the riser tension ring 3. The tension ring 3 is attached to the outer part of the telescopic joint 4A (the telescopic joint 4A is not shown in FIG. 2). Each actuator 1 is connected to a bundle of hoses and cables 21 with a flexible suspension, which are connected to associated equipment on the floating installation 11A, among other things a power supply 46 and a control system 42.

Reference is now made to FIG. 4 in particular. The actuator housing 22 is arranged between an end cap 23, which constitutes a first attachment point, and a motor casing 24 to which it is attached by means of bolts 25.

The motor casing 24 includes at least an electric motor 26 with an external stator 27 and an internal rotor 28. The stator 27 fits in the motor casing 24 and is attached to this in such a way that it is prevented from moving relative to the motor casing 24.

The motor 26 is provided with one, possibly several, sets of stators 27 which are each supplied with electrical current via a respective cable 29, the cable 29 extending in a sealing manner through a respective cable bushing 30 in the end cap 31A of the motor casing 24.

An actuator nut 32 is arranged internally in the rotor 28 and is connected to this via a planetary gear 28A. The rotor 28 is supported in the radial direction by means of bearings 28B, 28C, which are arranged at the end portions of the rotor 28. The actuator nut 32 is supported in the axial and radial directions by means of bearings 33A, 33B which are arranged at the end portions of the actuator nut 32.

In this preferred exemplary embodiment, the actuator nut 32 is provided with a number of supported threaded rollers 34 arranged axially and distributed around a cylindrical actuation element 35. The threaded rollers 34, which are arranged to rotate freely around their own longitudinal axes in the actuator nut 32, are in engagement with external threads 36 on the actuation element 35. The actuator nut 32, the threaded rollers 34, the planetary gear 28A and the actuation element 35 thereby constitute the transmission element for transmitting power from the motor 26 to the actuation element 35, which is provided with a second attachment point 37 at the outer end.

The motor casing 24 is provided with a first cooling jacket 38 encircling the stators 27. The inflow and outflow of a cooling medium are not shown. A second cooling element 39 is placed internally in the cylindrical actuation element 35. The cooling element 39 and the inflow and outflow of a cooling medium are not shown.

The motor casing 24 will typically be certified for use in a hazardous area. For example, the Exp principle is used. The motor casing 24 is purged with protective gas before start and pressurized with clean air or inert gas during operation. Possibly, liquid is used. The inside of the motor casing 24 is then defined as a safe zone. The end cap 31A is provided with a port for air supply 40 and a port 41 for measuring overpressure in the motor casing 24.

The motor 26 is provided with at least two independent position indicators, not shown, which, via connection and signal processing in a control system 42, give information on the relative position of the actuation element 35 in the actuator 1.

The internal portion of the actuator housing 22 constitutes a guide for the actuation element 35 and is provided with supporting sleeves 43 and spacer pipes 44.

The motor casing is provided with supporting sleeves 45A, 45B at either end for the actuation element 35.

The actuator may be provided with an electronically activated brake 47, which keeps the riser in a hoisted position after disconnection.

The systems are connected via flexible hose and cable connections 21 to associated equipment providing signal communication, the power supply 46, the control system 42, a cooling medium, a lubricating medium and compressed air.

The power supply to the actuators will be supplemented with a battery pack (not shown) supplying current for active motor operation and storing electrical energy which is generated through regenerative braking with the motors 26 when the floating installation 11A is lifted up.

It should be noted that all the embodiments mentioned above illustrate the invention, but do not limit it, and persons skilled in the art may construct many alternative embodiments without departing from the scope of the attached claims. In the claims, reference numbers in brackets are not to be regarded as restrictive. The use of the verb "to comprise" and its different forms does not exclude the presence of elements or steps that are not mentioned in the claims. The indefinite article "a" or "an" before an element does not exclude the presence of several such elements.

The fact that some features are stated in mutually different dependent claims does not indicate that a combination of these features cannot be used with advantage.

The invention claimed is:

1. A method of heave compensation between a floating installation, which has a drilling floor, and at least a riser connecting to or a pipe extending down through a blowout preventer, wherein the method includes the steps of:

installing an electromechanical actuator with attachment points, in the form of an end cap and an anchoring point, between the floating installation and a suspension device for the riser or the pipe, the end cap being arranged in an actuator housing and the anchoring point being arranged in an end portion of an axially displaceable actuation element, and an electric motor being arranged in the actuator housing and engaging the actuation element;

connecting the electromechanical actuator to a power supply and a control system;

tensioning the riser or the pipe by axial displacement of the actuation element into the actuator housing; and heave-compensating for the relative vertical displacement between the floating installation and the tensioned riser or pipe by adjusting the length and power output of the electromechanical actuator by controlling the electric motor arranged in the electromechanical actuator by using the control system, and wherein the method further includes the steps of:

using the electromechanical actuator to control recoil generated by the release of elastic energy caused by the release of the tensioned riser or pipe from the blowout preventer by rotation of the electric motor caused by axial displacement of the actuation element;

hoisting the riser or the pipe to an upper position; and locking the riser or the pipe in the upper position by the electronically controlled engagement of a brake.

2. The method according to claim 1, wherein the method further includes the step of:

regenerating electric energy by rotation of the electric motor from a heave movement of the floating installation causing an axial displacement of the actuation element into the actuator housing.

3. The method according to claim 1, wherein the method further includes the step of:

prior to installing the electromechanical actuator, arranging the electric motor with both a stator and a rotor encircling the actuation element within the electromechanical actuator.

4. The method according to claim 3, wherein the method further includes the step of:

prior to installing the electromechanical actuator, connecting the rotor of the electric motor, via a planetary gear, to an actuator nut which is in threaded engagement with the actuation element via several threaded rollers.

* * * * *